United States Patent [19]

Scheuring

[11] Patent Number: 4,607,446

[45] Date of Patent: Aug. 26, 1986

[54] MUZZLE LOADER

[76] Inventor: Melvin W. Scheuring, 18053 Bennett Rd., North Royalton, Ohio 44133

[21] Appl. No.: 713,154

[22] Filed: Mar. 18, 1985

[51] Int. Cl.[4] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 163,404 | 5/1875 | Phillips | 42/90 |
| 4,094,098 | 6/1978 | Gourley | 42/90 |
| 4,112,606 | 9/1978 | Griffin | 42/90 |
| 4,135,322 | 1/1979 | Tice et al. | 42/90 |
| 4,369,594 | 1/1983 | Zurga | 42/90 |
| 4,411,088 | 10/1983 | Wilson | 42/90 |
| 4,442,620 | 4/1984 | Drake et al. | 42/90 |
| 4,550,517 | 11/1985 | Mansfield | 42/90 |

*Primary Examiner*—Charles T. Jordan

*Attorney, Agent, or Firm*—Shlesinger, Arkwright, Garvey & Fado

[57] ABSTRACT

A charging block for a muzzle loading firearm includes an elongated block having a top face and a bottom face and side faces therebetween providing a vertical dimension. A plurality of shot-receiving apertures are disposed in the block and the apertures are angularly spaced apart on a generatrix of constant radius. A flexible punch pad is pivotally connected to the block at the generatrix. A punch block is secured to a second end of the punch pad and is alignable with the apertures by pivoting of the punch pad so that the punch block is positionable in the apertures. The punch block is of sufficient length to force shot from the apertures when the block is inserted fully therein.

20 Claims, 4 Drawing Figures

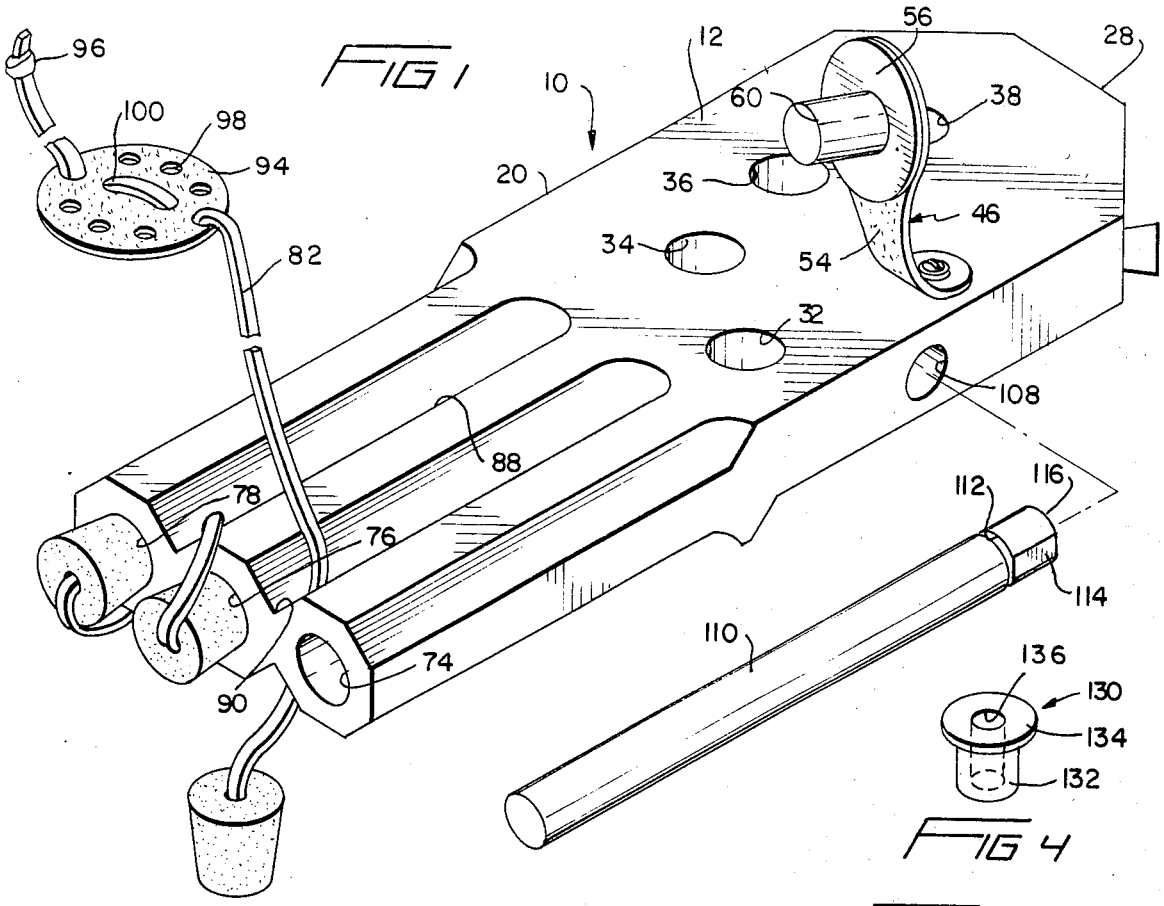
FIG 1
10
12
20
28
56
60
38
36
46
34
54
32
108
88
78
76
74
90
96
100
98
94
82
112
116
114
110
136
130
134
132
FIG 4
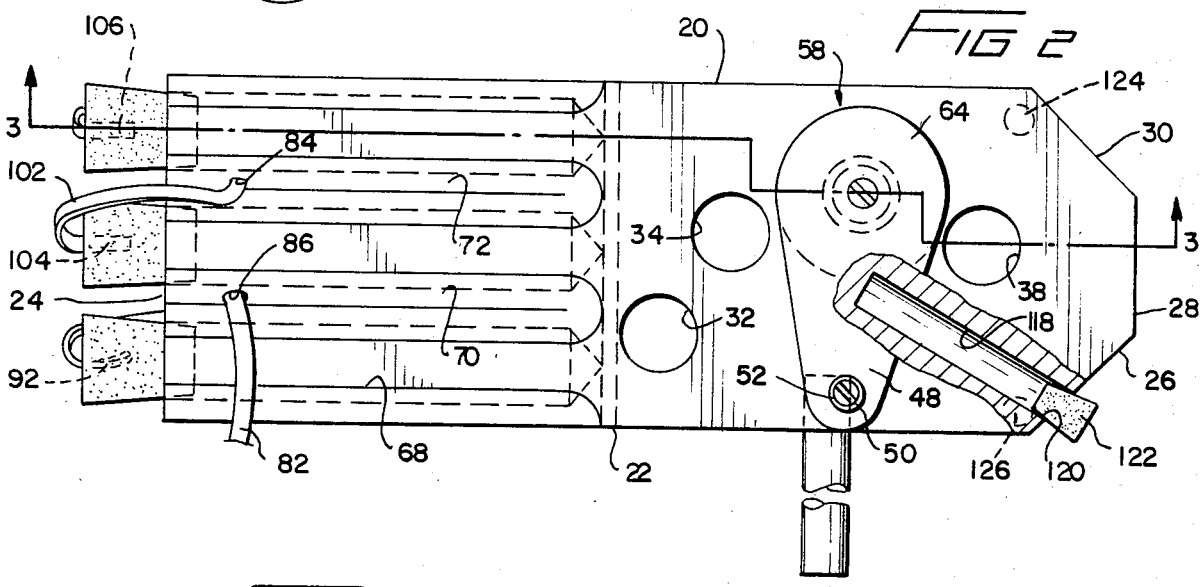
FIG 2
106
20
58
124
64
30
3
84
102
104
86
72
34
38
24
32
118
28
92
70
52
48
26
82
68
22
50
126
120
122
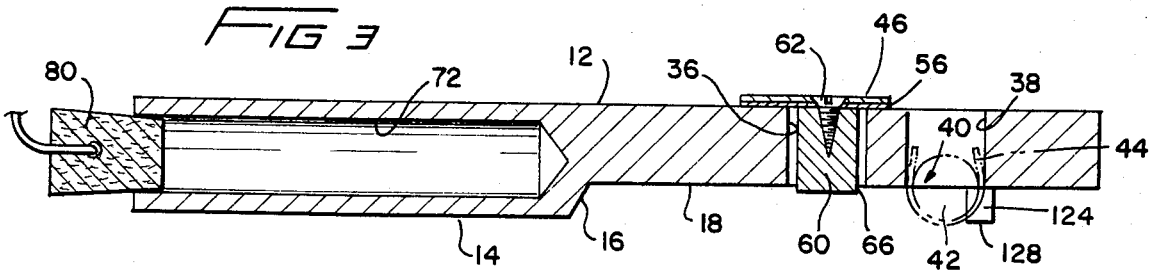
FIG 3
80
72
12
36
62
46
56
38
40
44
124
14
16
18
60
66
42
128

MUZZLE LOADER

BACKGROUND OF THE INVENTION

The recent Bicentennial anniversary of the United States has caused many individuals to become interested in the history of those times, including the history of the firearms which were utilized. Muzzle loading firearms, particularly rifles, have been obsolete for quite some time. However, the firing of muzzle loading firearms, particularly rifles, has recently begun to grow as a hobby or sport among many individuals. This increasing interest has likewise brought about an increased demand for authentic appearing articles used in the firing of these weapons.

The preparation of a muzzle loading rifle for firing requires a powder charge, a projectile or shot, a starter rod and a primer. Preferably, the charging materials are provided in an authentic looking device, sized to be conveniently inserted into a conventional shirt pocket. The device must be authentic looking in appearance if it is to complement the use of an antique firearm.

OBJECTS AND SUMMARY OF THE INVENTION

The primary object of the disclosed invention is to provide a muzzle loader which is authentic in appearance and which provides supplies of powder and shot sufficient to charge a plurality of firearms.

The disclosed invention provides a unitary packet for all charging materials and accessories and comprises a wooden block having a plurality of apertures therethrough angularly spaced apart on a generatrix of constant radius. Each of the apertures is tapered at the bottom end and is sized to receive a single shot, preferably a patched ball. A punch pad is pivotally secured at one end to the block and has a punch block affixed to the opposite end thereof which is selectively positionable in each of the apertures so that the application of force to the upper surface of the punch pad causes the punch block to engage the shot and force the shot from the aperture into the barrel of the rifle. Preferably, three shot receiving apertures are provided and a similar number of powder-containing chambers which are transversely disposed to the axis of the apertures. In this way, the disclosed invention permits the user to charge and fire the weapon three times.

The bottom face of the block of the invention has a recess of substantial area underneath the apertures. A wooden dowel or peg extends from the bottom face and provides a gauging device for assuring that the shot is properly positioned in its shot receiving aperture. A primer powder receiving chamber is disposed in the block proximate the apertures and is angularly disposed relative to the primary powder receiving chamber.

From the above, it can be seen that the disclosed invention provides an authentic appearing and novel muzzle loader which is sized to be advantageously positioned in a conventional shirt pocket. The block is comprised of wood so that it may be finished similar to the stock of the weapon with which it is used. A unique locking mechanism is provided for securing the starter rod to the block. This prevents the starter rod from inadvertently becoming lodged in the barrel of the weapon.

Muzzle loading weapons come in numerous sizes or calibers. The disclosed invention includes an apertured bushing which is positionable in the shot receiving apertures. The aperture of the bushing permits shot of a reduced caliber to be carried by the device. In this way, a single muzzle loader may be utilized to charge weapons of a caliber different from that for which the muzzle loader is primarily designed.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a perspective view of the muzzle loader of the invention;

FIG. 2 is a top plan view thereof with portions broken away;

FIG. 3 is a cross-sectoinal view taken along the line 3—3 of FIG. 2 and viewed in the direction of the arrows; and, FIG. 4 is a perspective view of a bushing forming a part of the invention.

DESCRIPTION OF THE INVENTION

Muzzle loader 10, as best shown in FIGS. 1–3 , is an elongated block, which may be made of plastic, wood or other suitable material, but is preferably made of maple wood, having a top face 12 and a parallel bottom face 14. As best shown in FIGS. 1 and 3, a substantial portion of the bottom face is recessed at 16 to provide a second bottom face 18 which is likewise parallel to top face 12. It can be seen, therefore, that the distance between top face 12 and bottom face 14 exceeds the distance between top face 12 and second bottom face 18, for reasons to be explained later.

The block 10 is, preferably, solid and provides parallel sides 20 and 22 and parallel ends 24 and 28 extending transverse to sides 20 and 22. One end of block 10 is reduced in width by providing inwardly tapering wall portions 26 and 30 bet-ween sides 20 and 22 and end 28, in order to facilitate insertion of the muzzle loader 10 into a conventional shirt pocket.

Apertures 32,34, 36 and 38 are disposed in block 10 between top face 12 and second bottom face 18. The apertures 32, 34, 36 and 38 have similar diameter and are angularly spaced apart, preferably by equiangular amounts, on a generatrix of constant radius. In this way, it can be seen that the apertures 32, 34, 36 and 38 may be thought to be disposed along the circumference of a circle. The apertures 32, 34, 36 and 38 have inwardly tapered wall portions 40, as best shown in FIG. 3. The apertures 32,34,36, and 38 have a diameter slightly larger than the diameter of shot 42, which preferably is a 54 caliber shot. The shot 42 is exteriorly surrounded by a patch or gauze 44. The taper 40 of the apertures 32, 34, 36 and 38 is sufficient to cooperate with the gauze 44 and thereby securely positions the shot 42 in the aperture. Consequently, the gauze 44 is gripped between the wall and the tapered portion 40 of the aperture so that the ball 42 will not escape therefrom.

It is a salient feature of the present invention to provide a flat punch pad 46 of leather or other suitable semi-flexible material, which is generally of egg shape. The smaller end 48 of the punch pad 46 is pivotally secured to the top face 12 of the block 10 at the generatrix by a screw 50. It can be noted in FIG. 3 that a substantial portion of punch pad 46 lies flat on face 12. A washer 52 is interposed between the upper surface of punch pad 46 and the head of screw 50 to prevent tearing of the punch pad. The screw 50 is tightened to a degree which sufficiently fastens punch pad 46 to the block 10 while at the same time permitting the punch pad 46 to pivot about screw 50.

As shown to advantage in FIGS. 1–3, a large washer 56, which complements the shape of the large end 58 of egg-shaped punch pad 46, is glued or fixed in any suitable fashion to the lower surface 54 of the punch pad 46. A cylindrical punch block 60 of wood or other rigid material extends through the central opening of washer 56, and is secured to punch pad 46 by a screw 62. Referring to FIG. 3, it will be seen that the length of the punch block 60 is at least equal to the distance between faces 12 and 18, and the diameter of the cylindrical block 60 is only slightly less than that of apertures 32, 34, 36 and 38. Insertion of the punch block 60 into any one of the apertures 32, 34, 36 and 38 and the application of force to the upper surface 64 of punch pad 46 will cause the end 66 of punch block 60 to engage the ball 42 and cause same to be expelled with the gauze 44 from the aperture in which it is held. It can be appreciated that the pivotal mounting of the punch pad 46 with the block 10 permits the punch block 60 to be selectively inserted into each of the apertures 32, 34, 36 and 38. Likewise, the screws 62 and 50 are separated or spaced apart by a distance equal to the radius of the circle about which the apertures 32, 34, 36 and 38 is disposed. Generally, the aperture 32 does not contain shot and is utilized to hold the block 60 during periods of non-use so that the pad 46 can lie flat on face 12.

As best shown in FIGS. 1–3 powder-receiving chambers 68, 70 and 72 are disposed in longitudinally extending parallel relation in the left side portion of block 10, as viewed in FIG. 2. Each of the chambers 68, 70 and 72 is of sufficient volume to receive and retain a quantity of powder which permits firing of the rifle. The powder chambers 68, 70 and 72 have respective openings 74, 76 and 78 in side wall 24 in order to permit the powder to be poured into the chambers or to be poured therefrom. Each of the openings 74, 76 and 78 is sealed by a frustoconical cork or stopper 80, which may be easily removed from or inserted into the respective openings 74, 76 and 78.

A leather thong 82 has a first end secured in cork 80 which seals chamber 68. The block 10 includes apertures 84 and 86, preferably centrally aligned with recesses 88 and 90. The recesses 88 and 90 extend longitudinally along top surface 12 and bottom surface 14 between the powder chambers 72 and 70 and 70 and 68. The leather thong 82 extends through aperture 86 and has the end 92 thereof secured in the cork 80 sealing opening 74. A capper patch 94 is slidably mounted on thong 82 adjacent knot 96. The capper patch has a plurality of circumferentially disposed openings 98 adapted for receipt of a primer cap and openings 100 for receipt of thong 82 so that the capper patch 94 may slide on the thong 82.

A second leather thong 102, shorter than thong 82, extends through aperture 84 and has a first end 104 secured in the cork 80 sealing chamber 70 and a second end 106 secured in the cork 80 sealing opening 78. In this way, the thongs 82 and 102 maintain the corks 80 in attachment with the loader 10, even after removal from the respective openings in the powder-chambers.

A bore 108 extends into block 10 through side 22 in alignment with screw 50, with the result that a portion of the screw extends into the bore 108 and thereby partially blocks the bore 108. Long starter 110, as best shown in FIG. 1, is a cylindrical dowel or rod of wood or other suitable rigid material. Starter 110 has a circumferential groove 112 adjacent one end thereof. Flat 114 extends forwardly from groove 112 to the terminal end 116 of starter 110. The flat 114 thereby provides the starter 110 with a terminal portion of reduced diameter. Insertion of the terminal end 116 into bore 108 with the flat 114 adjacent the screw 50 permits the terminal end 116 to be seated in the bore 108. This causes the groove 112 to be aligned with the portion of the screw 50 extending into the bore 108, as best shown in FIG. 2. Thereby, rotation of the starter 110 causes the screw 50 to be seated in the groove 112 so that the starter 110 is thereby prevented from being removed from the bore 108. Should removal be desired, then rotation is again necessary until the flat 114 is aligned with the screw 50.

As best shown in FIG. 2, bore 118 extends through angled portion 26 into block 10 generally transverse to the axis of the shot receiving apertures. Bore 118 has an opening 120 which is sealed by cork 122. The bore 118 is angularly disposed relative to the axes of the powder-receiving chambers and is utilized for storing primer powder or charge caps.

As best shown in FIG. 2, pegs 124 and 126 are disposed in block 10 and extend downwardly from second face 18, as best shown in FIG. 3. The pegs 124 and 126 have a terminal end 128 which lies in the plane defined by bottom surface 14. The pegs 124 and 126 thereby stablize the muzzle loader 10 when layed on a flat surface while simultaneously acting as a depth gauge for the balls 42. It can be seen in FIG. 3 that the ball 42 is aligned with terminal end 128 because of the peg 124. In this way, insertion of the balls 40 to the proper depth in the charge holding apertures 32, 34, 36 and 38 may be readily accomplished.

Bushing 130 is shown in FIG. 4 and is utilized to permit shot of a smaller size to be used with a standard size muzzle loader 10. The bushing 130 has a main tubular portion 132 and a flange 134 extending radially outwardly from the upper end thereof. Aperture 136 is centrally disposed in bushing 130 and is utilized for holding the smaller size shot. As can be appreciated, the tubular portion 132 is positioned in one of the shot-receiving apertures 32, 34, 36 and 38 and is pressed downwardly until the bottom surface of the flange 134 engages top surface 12. Naturally, a plurality of bushings 130 would be provided for each shot size so that each shot receiving aperture would have a bushing 130 positioned therein. Additionlly, the diameter of the aperture 136 may be selected for each shot size so that a plurality of bushings, each usable with a separate size shot, may be utilized by a standard charging block 10.

OPERATION

Operation of the muzzle loader 10 of the invention is fairly simple and straight forward. Initially, the terminus 116 of the long starter 110 is aligned with the bore 108 so that the flat portion 114 is adjacent the screw 50. The terminus 116 is inserted into the bore 108 until seated therein. This causes the screw 50 to be aligned with the groove 112 so that rotation of the long starter 110 will cause the screw to be engaged in the groove and thereby securely fasten the long starter 110 to the muzzle loader 10. The cork 80 of one of the powder receiving chambers 68, 70 and 72 is then removed and the charge contained therein is poured into the barrel. Preferably, the center chamber 70 is emptied first. Also, the removed cork 80 should not be inserted back into its respective opening in order to provide an indication of use. The punch pad 46 is next pivoted on the screw 50 until the punch block 60 is aligned with one of the shot-containing apertures 34, 36 and 38. The selected shot-containing aperture 34, 36 or 38 is then centered over the barrel, and force is applied to the upper surface 64 of the punch pad 46 of sufficient intensity to cause the ball 42 to be forced from the aperture into the barrel. The long starter 110 is then inserted into the barrel and pushes the ball deeper into the barrel. The ram-rod of the rifle is then utilized to seat the ball and the end of the ramrod may be positioned in the now empty powder-receiving chamber so that the muzzle loader 10 can be used as a handle. A cap may then be removed from the capper 94 or priming powder may be removed from the bore 118. The rifle (not shown) will now be ready to fire.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A muzzle loader, comprising:

(a) an elongated block having a top face and a bottom face and side faces therebetween providing a vertical dimension;

(b) a plurality of shot-receiving apertures through said top and bottom faces and said apertures being angularly spaced apart on a generatrix of constant radius;

(c) a flexible punch pad pivotally connected proximate one end thereof to said block at said generatrix; and (d) a punch block secured proximate a second end of said punch pad and being alignable with said apertures by pivoting of said punch pad so that said punch block is positionable in said apertures and said punch block being of sufficient length to force shot from said apertures when inserted fully therein.

2. The loader as defined in claim 1, wherein:

(a) at least a first open-ended powder chamber being disposed in said block and extending generally transverse to the axes of said apertures; and, (b) seal means removably block the open end of said chamber.

3. The loader as defined in claim 2, wherein:

(a) said seal means includes a tapered cork.

4. The loader as defined in claim 1, wherein:

(a) each of said apertures being inwardly tapered proximate said bottom face for securly holding shot.

5. The loader as defined in claim 1, wherein:

(a) a recess of substantial area being disposed in said bottom face proximate said apertures providing a second bottom face; and, (b) a plurality of pegs extending from said second bottom face and terminating on a plane parallel to said bottom face for providing a depth gauge when shot is inserted into said apertures.

6. The loader as defined in claim 5, wherein:

(a) said top face, bottom face and second bottom face being parallel.

7. The loader as defined in claim 1, wherein:

(a) a disk of substantial diameter being secured to the bottom surface of said punch pad at generally said second end, and, (b) said punch block engaged with and extending generally transverse to said disk.

8. The loader as defined in claim 5, wherein:

(a) said punch block having a length exceeding the vertical dimension between said top face and said second bottom face.

9. The loader as defined in claim 2, wherein:

(a) a plurality of open-ended powder chambers extending in parallel relation and being disposed in said block.

10. The loader as defined in claim 9, wherein:

(a) an open ended primer powder chamber being disposed in said block proximate said apertures and being angularly disposed relative to said powder chambers; and, (b) seal means removably seal said primer powder chamber.

11. The loader as defined in claim 1, wherein:

(a) a neutral aperture being disposed through said top and bottom faces providing a rest hole for said punch block so that said punch pad lays substantially flat on said top surface.

12. The loader as defined in claim 1, wherein:

(a) said punch block being cylindrically-shaped and having a diameter substantially equal to the diameter of said apertures.

13. The loader as defined in claim 1, wherein:

(a) said block being comprised of a wood product.

14. The loader as defined in claim 1, further comprising:

(a) a bore disposed in said block through one of said sides; and, (b) a starter rod removably secured in said bore.

15. The loader as defined in claim 14, wherein:

(a) screw means secure said one end to said block and said screw means having a portion thereof disposed in said bore; and, (b) said starter rod having a groove proximate one of said ends and a flat portion of reduced diameter extending toward the adjacent end from said groove so that insertion of the end into said bore with said flat portion adjacent said screw means and subsequent rotation of said starter rod causes said screw means to be engaged by the walls of said groove and thereby prevents removal of said starter rod.

16. The loader as defined in claim 1, further comprising:

(a) thong means of substantial length having a first end connected to said block; and, (b) a capper removably secured to said thong means.

17. The loader as defined in claim 1, further comprising:

(a) apertured bushing means having an external diameter substantially equal to the diameter of said apertures; and, (b) said bushing means being positionable in one of said apertures so that the aperture of said bushing means may receive shot of a caliber less than that receivable by said shot receiving apertures.

18. The loader as defined in claim 17, wherein:

(a) a flange extends around said bushing means proximate one end thereof for positively seating said bushing means in the selected aperture by engagement of a face of said flange with said top face.

19. The loader as defined in claim 7, wherein:

(a) said punch pad being egg-shaped and said disk being secured to the large end thereof for providing increased force receiving capability during removal of shot from said apertures.

20. A method of loading a muzzle loading firearm by means of a charge block having a plurality of shot-holding apertures angularly spaced apart on a common generatrix of constant radius and said block having a punch pad pivotally connected at one end thereof to said generatrix and with a punch block extending from a second end thereof and being positionable in said apertures and being of a length sufficient to force the shot from the apertures and with the charging block further having at least a first powder receiving chamber, comprising the steps of:

(a) emptying the powder from said chamber into the muzzle of the firearm to be loaded;

(b) centering one of said shot holding apertures over the muzzle;

(c) pivoting said punch pad so that said punch block is aligned with said one aperture; and, (d) forcing said punch block into said aperture and thereby causing the shot to be forced from the aperture and into the barrel.

* * * * *